United States Patent [19]

May

[11] Patent Number: 4,685,236

[45] Date of Patent: Aug. 11, 1987

[54] GRAPHITE/METAL MATRIX GUN BARREL

[76] Inventor: Sam May, R.R. 3, Box 172 A, Flagstaff, Ariz. 86001

[21] Appl. No.: 615,234

[22] Filed: May 30, 1984

[51] Int. Cl.[4] ..... F41C 21/02; F41F 17/08

[52] U.S. Cl. ..... 42/76.02; 89/15; 428/367

[58] Field of Search ..... 42/76 R, 76 A; 89/14.05, 15, 16; 428/36, 367, 902

[56] References Cited

U.S. PATENT DOCUMENTS

| | | | |
|---|---|---|---|
| 2,847,786 | 8/1958 | Hartley et al. | 42/76 A |
| 3,228,298 | 1/1966 | Grandy et al. | 42/76 A |
| 3,641,870 | 2/1972 | Eig | 42/76 A |
| 3,720,257 | 3/1973 | Beutler et al. | 428/634 |
| 3,821,024 | 6/1974 | Wilkin et al. | 428/634 |
| 4,223,075 | 9/1980 | Harrigan, Jr. et al. | 428/634 |
| 4,341,823 | 7/1982 | Sexton et al. | 428/634 |
| 4,435,455 | 3/1984 | Prewo et al. | 42/76 A |
| 4,485,721 | 12/1984 | Shankhla | 89/15 |

*Primary Examiner*—Deborah L. Kyle
*Assistant Examiner*—Ted L. Parr
*Attorney, Agent, or Firm*—Cushman, Darby & Cushman

[57] ABSTRACT

A gun barrel is constructed of an inner tubular liner of hard material forming the bore of the barrel and an outer jacket of carbon-fiber reinforced metal matrix material in which the fibers are helically wound about the liner. In a preferred construction the jacket includes an inner region, an intermediate region and an outer region in each of which the fibers have specified wrap angles and specified mechanical properties in order to provide high bursting strength, high torsional stiffness and high beam bending stiffness.

12 Claims, 12 Drawing Figures

GRAPHITE/METAL MATRIX GUN BARREL

This invention relates to composite gun barrels incorporating carbon fibers as structural elements surrounding an inner liner and to methods for manufacturing such gun barrels.

BACKGROUND

As used herein the term gun barrel means any device having a projectile discharge bore wherein an exploding charge of propellant exerts a high gas pressure for a very short time on the projectile to eject it from the bore with desired ballistic characteristics. The present invention relates to gun barrels generally, without restriction as to bore size, and has particular utility with respect to gun barrels used in rapid fire weapons, because of the special problems which arise during use of such weapons. While the prior art discloses composite gun barrels, the applicant is not aware of any disclosure of the use of carbon fibers as structural elements in composite barrels.

The dynamic characteristics of gun barrels during use have received considerable attention in recent years in efforts to improve accuracy and reduce weight while maintaining the integrity of the barrels in terms of bore stiffness, erosion and strength. It is recognized, for example, that accuracy is adversely affected by vibrations which are induced by the stresses which are transmitted to the barrel as a result of the movement of the projectile through the bore. The vibrations can produce a significant transverse force component on the projectile at the instant of its departure from the bore as well as physical displacement and misalignment. As a a result there is likely to be a shift in the flight path of each successive projectile from a rapid fire weapon. Further, it is recognized that with a rifled bore the forces of acceleration coupled with the resistance of the projectile against the driving side of the lands of the rifling create a torque which may cause an angular displacement of perhaps 2° in the barrel. This torque is not detrimental in single shot fire because the barrel elastically returns to its original geometry before the next shot. However, in the case of rapid fire guns (e.g. a firing rate such as 800 rounds per minute) the torque induced by projectile rotational acceleration causes torsional vibration which is still active at the time the next projectile is fired. This results in a dynamic condition such that the geometry of the barrel may be different for each projectile. Thus, with rapid fire guns there is a dispersion of the cone of fire which is much greater than for static fire guns. It is estimated, for example, that the cone of fire for a 50 caliber machine gun at a range of 300 yards is ten feet.

Composite gun barrels are described in the prior art. U.S. Pat. No. 2,847,786 describes a composite barrel having a metal liner forming the bore and an exterior jacket of wound glass fibers or fibers of synthetic polymeric material bonded together with a binder such as a synthetic resin. U.S. Pat. No. 3,228,298 also describes gun barrels constructed of a metal liner and a jacket of glass fiber reinforced plastic. Neither of these patents describes the use of carbon filaments in the jacket.

U.S. Pat. No. 4,341,823 describes metal-coated carbon filaments such as nickel coated filaments. The coating may be applied by a vapor deposition technique, electroplating or by an electroless technique. The patent also describes carbon-filament reinforced metal matrix composite bodies formed by immersing bundles of metal coated carbon fibers in molten metal or by placing a bundle of such fibers in a mold cavity and applying molten metal. The patent does not disclose a gun barrel having a carbon fiber/metal matrix jacket on a bore-forming liner.

U.S. Pat. No. 4,223,075 describes carbon-filament-reinforced metal matrix composites, such as structural components in the form of rods and plates, made by first forming wire-like metal-carbon filaments, placing parallel bundles of the wire-like composites in molds, and consolidating the composites into an integral mass by heating and compacting. No mention of gun barrels is made.

Other U.S. patents which disclose metal coated carbon fibers, without reference to their possible use for manufacturing gun barrels, are U.S. Pat. Nos. 3,720,257 and 3,821,024.

U.S. Pat. No. 3,641,870 describes a completely non-metallic gun barrel, especially a mortar tube, made of glass fiber reinforced synthetic resin.

Summary of the Invention

The present invention provides a composite gun barrel comprising a tubular liner of hard material forming the bore and a composite jacket of helically wound carbon-fiber reinforced metal matrix applied to the exterior of the liner. The carbon-fiber composite jacket provides bursting strength, torsional resistance (stiffness) and beam bending stiffness, and it can withstand the heat generated by firing of the gun, especially the firing of rapid fire weapons. As the barrel is much lighter than an equivalent all steel barrel, the vibration frequencies during firing will be much higher and improved accuracy is obtained. With respect to heat barrels have been known to achieve such high temperatures that the barrel deflected to the degree that the projectiles passesd through the side wall of the barrel. The carbon composite with metal matrix greatly enhances resistance to such deflection. Further, the torsional resistance and beam stiffness of the composite cannot be achieved on the same scale by any other means which does not adversely affect either barrel weight, barrel geometry or the barrel support structure. The barrel is not restricted to rapid fire weapons or to a minimum bore diameter.

The hard material of the liner which forms the bore may be any suitable material, typically steel or other metals such as stainless steel, nickel, stellite, aluminum, titanium or molybdenum, capable of resisting projectile-induced erosion and of withstanding the stresses and heat incurred during firing of the weapon.

The preferred metal matrix material for the composite jacket is nickel (typical modulus of elasticity of $30\times10^6$ psi and typical ultimate tensile strength of 90,000 psi). Other metals such as iron may also be used. Typically the metal is in the form of a thin plated coating on the carbon fibers, applied by the manufacturer of the fibers or applied by the manufacturer of the gun barrel during application of the composite jacket. The coating is quite thin, usually not exceeding 0.0001 inch, but sufficient to produce a suitable bond with the carbon fibers and to form a continuous metal phase in the composite jacket while at the same time maintaining a minimum weight. Non-metal matrix materials, including those which are capable of withstanding the heat incurred, generally do not possess an adequate combination of properties. Also, when such non-metallic materials burn, they release micro-fine fibers into the air creating hazards of shorting electrical circuitry and of danger to the eyes and lungs.

The continuous fibers used to form the composite jacket may be commerically available fibers, and for purposes of the invention they are selected on the basis of their tensile strength and modulus of elasticity (stiffness) and they are wound on the liner in a prescribed manner as described more in detail hereinafter. The term "fiber" is employed herein in a broad sense to encompass individual filaments and plural-filament strands. Suitable carbon fibers are, for example, those made from monofilament rayon fiber which has been heated to extremely high temperatures while being stretched. The aforesaid U.S. Pat. Nos. 3720257, 3821014, 4223075 and 4341823 describe carbon fiber formation and/or metal plating of the fibers. Stress calculations have shown that the diameter of the individual filaments is of importance only in regard to maintaining a required jacket. The smaller the diameter the higher the percentage of fiber (the main constituent of the jacket) in a given volume. The diameter of the filaments may range, for example from 0.17 mils to about 0.0004 inch. The firmer the filaments are desirable in order to produce as thin a jacket as possible, consistent with the requirements of the gun barrel. The range of fiber count per yarn or tow may be, for example, 3000 to 12000 but has no significant affect on the final jacket.

The technique of winding the continuous carbon fibers onto the liner during formation of the jacket may be, in general, conventional, although prescribed angles of wind should be used in the preferred constructions. The fibers are wound with sufficient tension to avoid misalignment of the fibers and to provide proper spreading of the fibers into as thin a layer as can be achieved while achieving full coverage. The fibers in a given layer are wound in parallel side-by-side relationship. The metal matrix in the final jacket is a continuous phase and forms a bond to each fiber during the winding operation. The fibers during winding may or may not be in contact with each other, depending on whether the fibers are pre-plated or plated as part of the winding process.

Heat-treatment and/or compaction of the composite barrel after formation of the jacket is not contemplated. Heat treatment of the liner is conducted prior to winding as is the boring/rifling operation. Compaction after winding is avoided as this would tend to damage or fracture the bond between fibers and/or damage the fibers themselves. An additional outer metal coating can be provided on the jacket to protect the fibers from wear. The coating may be, for example, high density nickel and it may in turn be coated with a protective paint such as epoxy type paint, or a thin metal sleeve maybe applied to avoid damage, than painted.

In the overall jacket the metal matrix material constitutes about 10 volume % and ordinarily should not exceed about 20 volume %. The carbon fiber content of the jacket generally should be as high as possible, consistent with the overall strength requirements of the barrel; typically the jacket is about 62 volume % carbon fiber and 28 volume % voids.

Referring more in detail to the geometry of the carbon fibers in the preferred construction of the jacket an important feature of the invention is the presence in the metal matrix of high modulus or ultra high modulus carbon fibers, depending on the type of weapon, the fibers being helically wrapped around the tubular lining in superimposed layers. The metal matrix provides the interlaminar shear strength to transmit stress loads from the lining to the jacket and otherwise bond the carbon fibers together. The matrix also provides a heat transfer path for transmission of heat out of the barrel.

For purposes of this description high modulus carbon fibers means carbon fibers having a modulus of elasticity of at least about $50\times10^6$ psi and an ultimate tensile strength of above 340,000 psi, preferably 500000 psi. Ultra high modulus carbon fibers means carbon fibers having a modulus of elasticity of at least about $70\times10^6$ psi, preferably about $100\times10^6$ psi and an ultimate tensible strength of below 340000 psi, for example 280000 psi. The high modulus fibers are thus high tensile strength fibers relative to ultra high modulus fibers. On the other hand the higher modulus of elasticity of the ultra high modulus fibers renders these fibers considerably stiffer than the high modulus fibers.

In accordance with the preferred jacket construction of the invention the carbon fibers in the radially innermost region of the jacket are wound differently from the fibers in the radially outermost region. Also, the fibers in the two regions may have different properties, the fibers in the innermost region having greater tensile strength than the fibers in the outermost region, and the fibers in the outermost region having greater stiffness than the fibers in the innermost region.

Further, there may be an intermediate region in which the carbon fibers may be wound differently than in either of the other regions and in which the fibers may have the same or different properties relative to the fibers in the innermost region.

With respect to the innermost region of the jacket it is preferred that the carbon fibers in this region be wholly or predominantly high strength, high modulus fibers. To best resist torsional vibration, combined with high burst pressure, these fibers are wound in superimposed layers at an angle of about ±24.5° to a perpendicular to the barrel centerline, the angles of wrap in adjacent layers being opposite to each other. A "layer" may itself be a plurality wraps of the same wrap angle, or it may be a single wrap having a thickness of one fiber diameter. The wrap angle should not vary from 24.5°, preferably not more than about 1°, because the balance between torsional strength and bursting strength of the barrel falls off rapidly with greater divergence from the optimum angle. This region of the jacket, which is considerably thinner in radial dimension than the outermost region, provides a cushion or pad to absorb the thermal expansion of the lining during rapid fire (estimated barrel temperature of 1000° F. at the breach end) and thereby protects the high modulus and ultra high modulus carbon fibers which have a lower tensile strength (hence are more brittle).

The radially outermost region of the preferred jacket construction contains a proportion of fibers which are "longitudinal" with respect to the lining in the sense that their average angle of wrap is much greater than in the "circumferential" wrap in the innermost region, measured from a perpendicular to the barrel centerline. In a suitable region a preponderance, e.g. 67% of the wraps have a wrap angle of about ±75° and the remainder have a wrap angle of between about ±25° and about ±45°. Adjacent wraps are wound with opposite angles of wrap. The fibers are preferably ultra high modulus fibers, which possess higher stiffness than the fibers in the innermost region, but in some cases they may be the same high modulus fibers as the fibers in the innermost region.

In the preferred jacket construction there is also an intermediate region in which the carbon fibers are wrapped at angles between ±24° and ±45° to a prependicular to the barrel centerline, depending on the liner stress versus torsional stiffness requirement of the particular design. These fibers are preferably ultra high modulus fibers but in some cases they may be the same high modulus fibers as the fibers in the innermost region.

In another embodiment the jacket includes at least two radial regions of helically wound fibers, predominantly all of the fibers in the innermost region being wound at an angle of ±24.5° and the fibers in the outermost region being wound at different wrap angles up to about ±24.5° and having an average wrap angle substantially greater than about ±24.5° the wrap angles being measured from a perpendicular to the barrel centerline.

The stiffness (modulus of elasticity) varies in each region depending on fiber modulus, fiber orientation (geometry), fiber density and metal content. Also, it varies with direction within the region.

In designs where some stiffness can be compromised (such as for reasons of cost), the composite jacket can be made using high modulus fibers of sufficient strength in lieu of ultra high modulus fibers.

A 50 caliber gun barrel made in accordance with the invention as a replacement, in terms of dimensions, for an existing all steel (AISI-4150) barrel (i.e. same chamber, length, bore size and outside diameter) has been shown by calculation to have, relative to the steel barrel, 23% greater bending stiffness (average along the length of the barrel), 50% greater torsional stiffness (average along the length of the barrel) and 50% lighter. Lightness is of course of extreme importance in aircraft armament. Lightness is also of importance in ship-mounted guns where for example reducing the weight of gun barrels, and consequently the weight of related counterbalances and drive mechanisms, lowers the center of gravity of the ship.

DESCRIPTION OF EXEMPLARY EMBODIMENT

Figure 1:
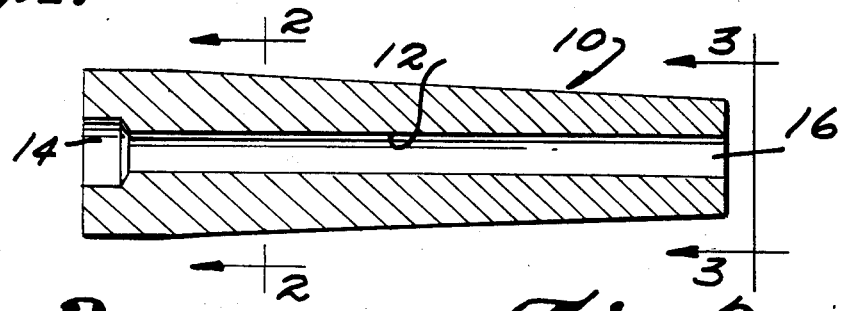
FIG. 1 is a longitudinal sectional view of a conventional all steel gun barrel.
Figure 2:
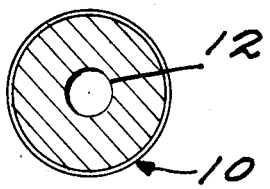
FIGS. 2 and 3 are sectional views taken on the lines 2—2 and 3—3 of FIG. 1.
Figure 3:
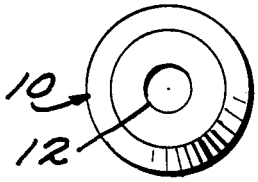

FIGS. 1-3 illustrate a conventional all-steel gun barrel 10, such as a 50 caliber machine gun barrel capable of being fired at a rate of 800 rounds per minute, the barrel having a rifled bore 12, a breach end 14 and a muzzle end 16.

Figure 4:
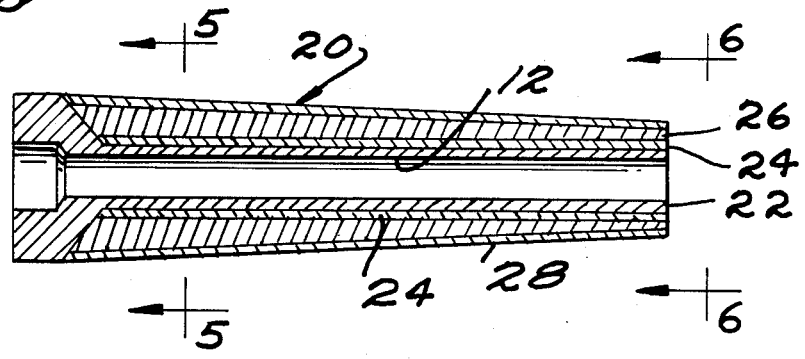
FIG. 4 is a longitudinal sectional view of a composite gun barrel manufactured as a replacement for the all-steel barrel of FIG. 1.
Figure 5:
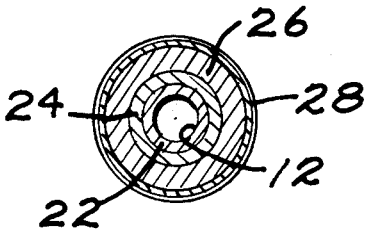
FIGS. 5 and 6 are sectional views taken on the lines 5—5 and 6—6 of FIG. 4.
Figure 6:
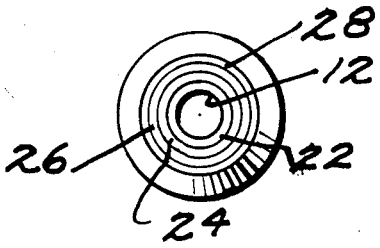

FIGS. 4-6 illustrate a replacement gun barrel 20 constructed as a composite in accordance with the principles of the present invention, the barrel having the same bore size, length and outside diameter as the all-steel barrel of FIGS. 1-3.

The composite gun barrel 20 includes a thin-walled inner tubular liner 22 of steel which forms the rifled bore 12. Applied to the exterior of the liner 22 is a thin region 24 (for example 0.11 inches thick) of continuous carbon fiber reinforced metal matrix material in the form of helically wrapped high tensile strength carbon fibers (as defined previously) in a nickel matrix. The nickel can be applied to the fibers as they are wound onto the liner 22, or it can be applied as a flash coating prior to winding (to provide enhanced handling and reduced inline desmutting, etching and rinsing), and a final coating being applied directly to the fiber as the fiber is wound to provide a bond and seal. The wrap angle is ±24.5° from a perpendicular to the barrel axis and there is a plurality of fiber lays with adjacent lays having opposite angles of wrap. The fibers may be, for example, wholly or predominantly fibers having a modulus of elasticity of $52\times10^6$ psi and an ultimate tensile strength of 340,000 psi, available as Celion G-50 fibers from Celanese Corp.

Radially outward of the region 24 is an intermediate region 26 of plural lays of carbon-fiber reinforced nickel matrix in which the fibers are high modulus fibers as defined previously. The angle of wrap is ±24.5° from a perpendicular to the barrel axis and adjacent lays have opposite angles of wrap.

Radially outward of the region 26 is a region 28 of carbon fiber reinforced nickel in which the fibers are more longitudinally oriented than in the inner layers. In the illustrated construction one third of the wraps have a wrap angle of ±75° and the remainder a wrap angle of ±24.5°. The fibers in this region and in the intermediate region may be, for example, wholly or predominantly fibers having a modulus of elasticity of $100\times10^6$ psi and an ultimate tensile strength of 325,000 psi, available as Thornel P-1005 fibers from Union Carbide Corp.

The exterior of the barrel may be plated with nickel for protective purposes, or other protective measures may be employed as required.

Longitudinal windings (e.g. 75° wrap angle) should be used only in the radially outer portions of the jacket where bending stiffness is achieved. Use of such windings in the inner portions would reduce the ability of the barrel to resist internal pressure. The objective is to resist high pressure vessel stresses in inner portions and provide stiffness in torsion and bending in the outer portions as would an I beam.

The ranges of tensile strength and modulus of elasticity (a measure of stiffness) of the fibers are variables arranged to suit differing requirements, i.e. torsional strength and bending resistance versus bursting strength. This is dictated by whether the weapon has a high cyclic rate of fire (creating high temperatures) or a low cyclic rate of fire not producing such high temperatures. In large caliber, slow fire weapons such as 175 mm and 255 mm guns, the modulus can be lowered to some extent to provide a more economical product.

Figure 7:
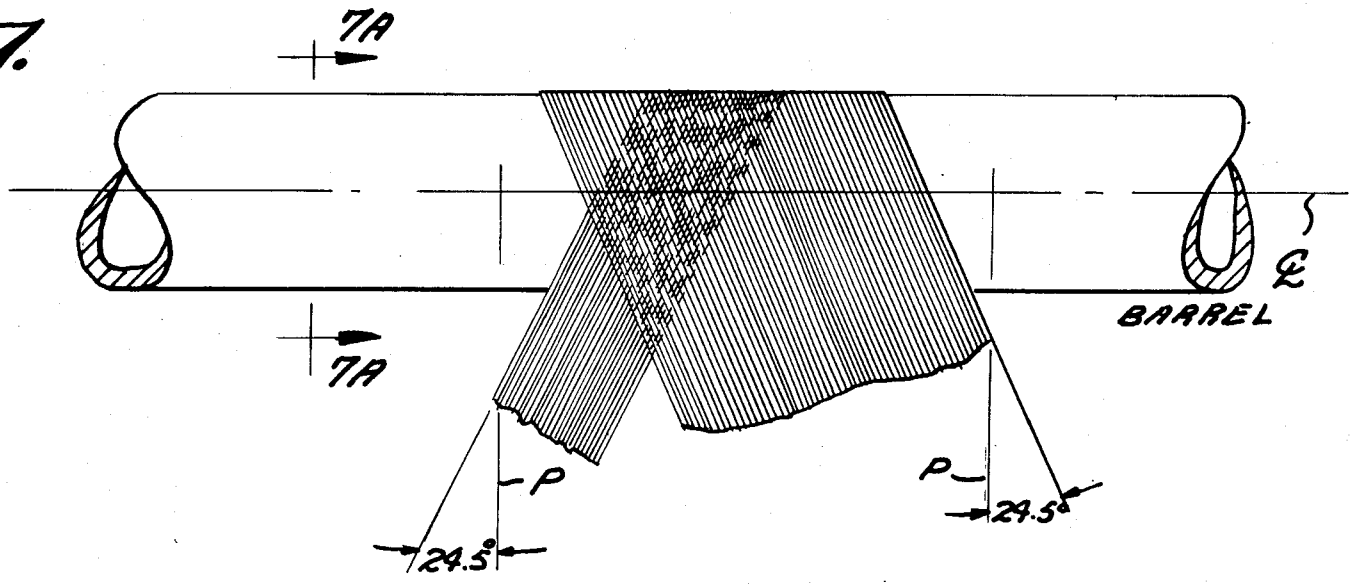
FIGS. 7, 8 and 9 are schematic side views illustrating the winding of the innermost layer, the intermediate layer and the outermost layer, respectively.
Figure 7A:
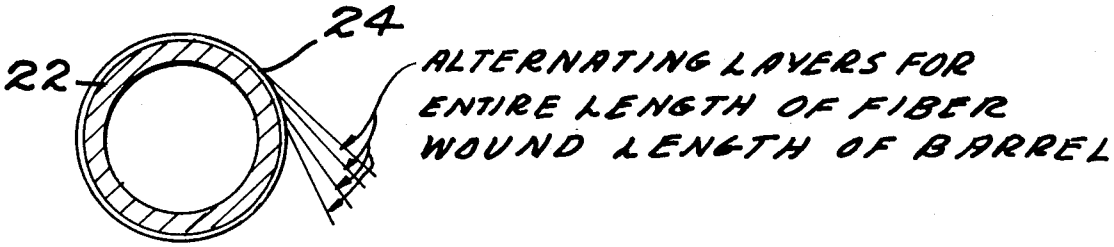
FIGS. 7A, 8A and 9A are sectional views taken on the lines 7A—7A, 8A—8A and 9A—9A of FIGS. 7, 8 and 9, respectively.

FIGS. 7 and 7A illustrate schematically the wrapping of the innermost region 24 of nickel-plated continuous carbon fibers **24*a* on to the steel liner 22**. Only two fiber layers are shown, these being radially adjacent each other and wound at opposite angles of 24.5° to a perpendicular P to the barrel centerline CL.

Figure 8:
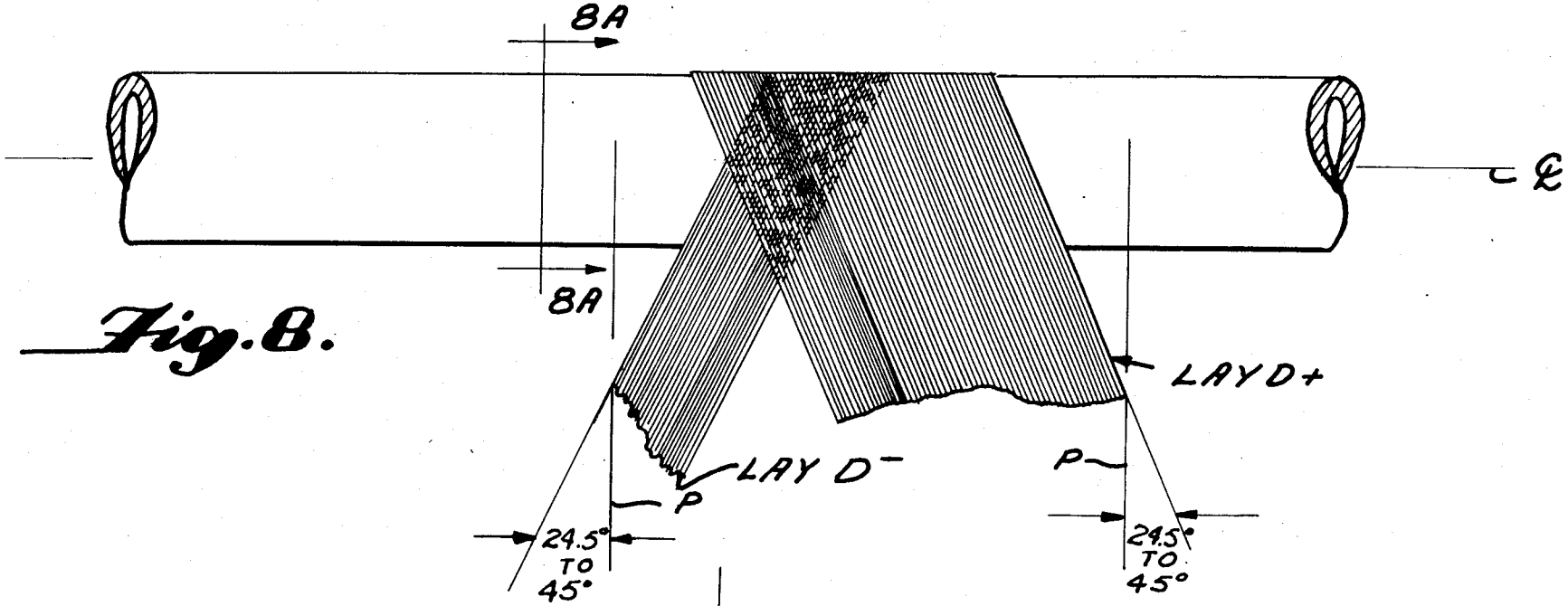
Figure 8A:
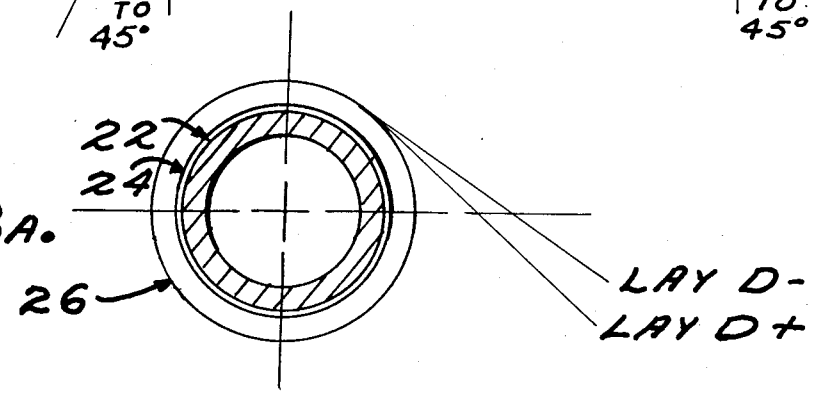

FIGS. 8 and 8A illustrate schematically the wrapping of the intermediate region 26 of nickel-plated continuous carbon filaments on to the previously-wound region 24. Again only two fiber layers are shown, these being wound at opposite angles of 24.5° to 45°.

Figure 9:
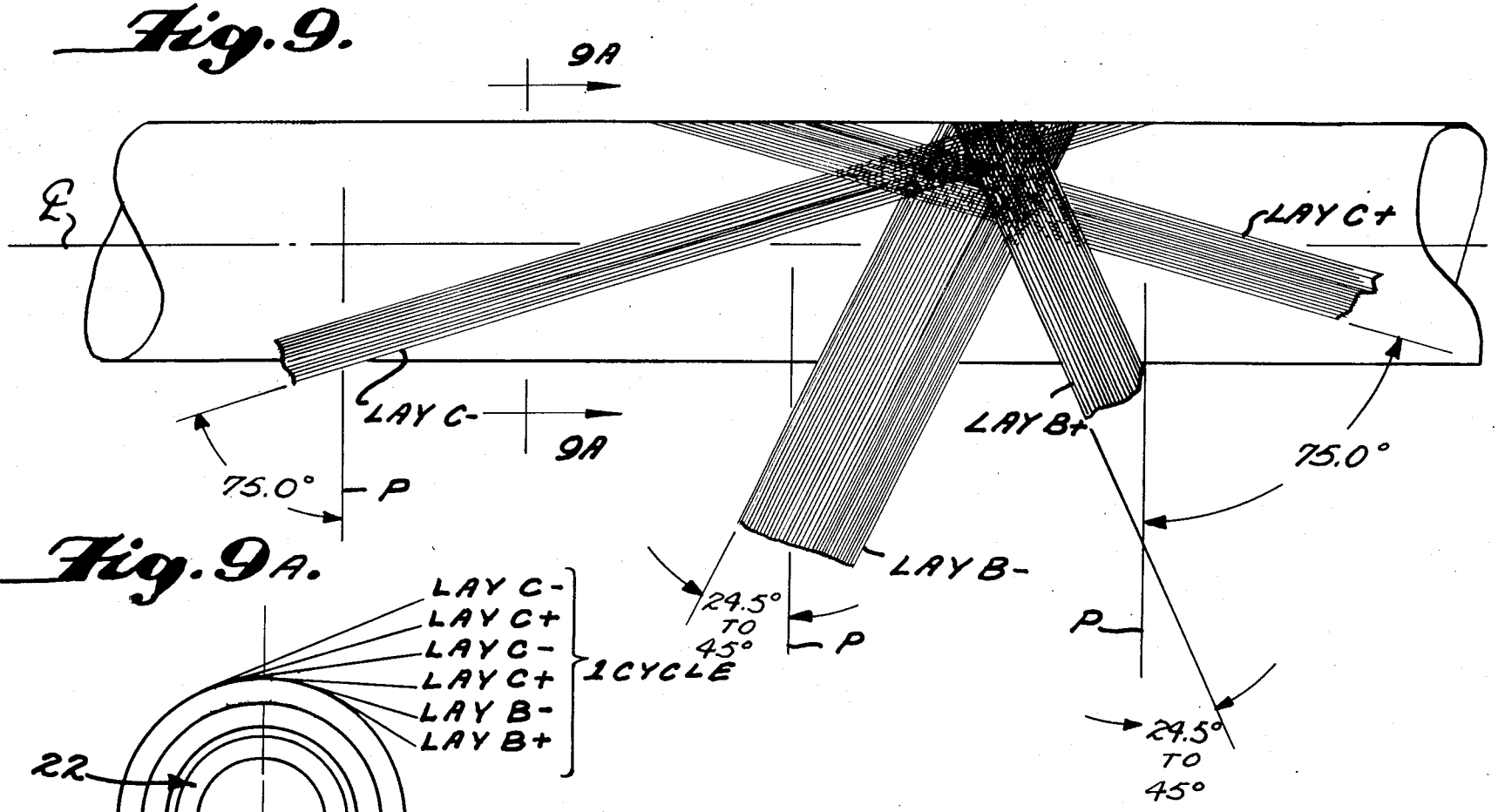
Figure 9A:
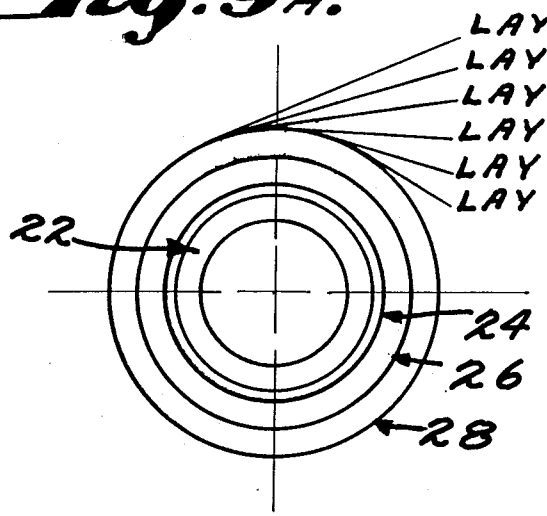

FIGS. 9 and 9A illustrate schematically the wrapping of the outermost region 28 of nickel-plated continous carbon filaments on to the previously-wound region 26. Four lays are shown in FIG. 9, these being, in order, lay $C^-$ (−75°), lay $C^+$ (+75°), lay $B^-$ (−24.5° to −45°) and lay $B^+$ (+24.5° to +45°). In practice a 6-wrap sequence is repeated to build up the desired thickness of the region, each sequence being approximately as follows: about one wrap of parallel tows with a wrap angle of about +24.5°, followed by about one wrap of about +75°, followed by about one wrap of about −75°, followed by about one wrap of about −75°.

What is claimed is:

1. A gun barrel comprising an inner tubular liner forming the bore of the barrel and an outer annular jacket of carbon-fiber reinforced metal matrix material which includes at least two radial superimposed regions of wound fibers, the fibers in a first, inner region having higher ultimate tensile strength than the fibers in a second outer region and the fibers in outermost region having a higher modulus of elasticity than the fibers in the innermost region.

2. A gun barrel as in claim 1 wherein predominantly all the fibers in the first region are wound at about an angle ±24.5° relative to a perpendicular to the barrel centerline, and wherein the fibers in the second region are wound at various angles between ±24° and ±45° relative to a perpendicular to the barrel centerline.

3. A gun barrel as in claim 1 wherein the carbon-fiber reinforced metal matrix material includes a third region surrounding the second region in which the fibers are helically wound fibers having high or ultra-high modulus of elasticity, a predominance of the fibers being wrapped at an angle of ±75° and the remainder being wrapped at about an angle between about ±25° and ±45°.

4. A gun barrel as in claim 1 wherein the metal in the jacket constitutes about 10%–20% by volume of the jacket.

5. A gun barrel comprising an inner tubular liner of hard metal forming the bore of the barrel and bonded to the exterior of the liner a jacket of continuous carbon fibers helically wound about the liner and embedded in a continuous metal matrix, said jacket including at least two radial regions of helically wound fibers, the fibers in the innermost layer having higher ultimate tensile strength than the fibers in the outermost layer and the fibers in the outermost layer having a higher modulus of elasticity than the fibers in the innermost layer.

6. A gun barrel as in claim 5 wherein the metal matrix is selected from the group consisting of nickel, chrome and tungstu.

7. A gun barrel as in claim 5 wherein the ultimate tensile strength of the fibers in the innermost layer is above about 340,000 psi and wherein the modulus of elasticity of the fibers in the outermost layer is at least $50\times10^6$ psi.

8. A gun barrel as in claim 7 wherein the ultimate tensile strength of the fibers in the radially innermost layer is at least 500,000 psi.

9. A gun barrel as in claim 5 wherein in the innermost region are wound at an angle of ±24.5° and the fibers in the outermost region are wound at different wrap angles up to about ±75° and having an average wrap angle substantially greater than about ±24.5°, the wrap angles being measured from a perpendicular to the barrel centerline.

10. A gun barrel as in claim 9 wherein a majority of the fibers in the outermost region are wound at about ±75°.

11. A gun barrel as in claim 9 wherein said jacket includes an intermediate region between the innermost and outermost regions, the fibers in the intermediate region being wound at angles between about ±24° and about ±45°, the angles being measured from a perpendicular to the barrel centerline.

12. In a gun, a gun barrel having a breach end and a muzzle end, said gun barrel comprising an inner tubular liner of hard material and bonded to the exterior of the liner a composite jacket of continuous helically wound carbon fibers embedded in and surrounded by a continuous phase metal matrix, said jacket including an innermost radial region, an intermediate radial region and an outermost radial region, predominantly all the carbon fibers in the innermost region having a wrap angle of about ±24.5° and having an ultimate tensile strength above 340,000 psi, the carbon fibers in the intermediate region having wrap angles between about ±24° and ±45° and having a modulus of elasticity of at least $50\times10^6$ psi, and a perponderance of the carbon filaments in the outermost region having a wrap angle of about ±75° and a modulus of $50\times10^6$ psi, said wrap angles being measured from a perpendicular to the barrel centerline.

* * * * *